US011761161B2

(12) United States Patent
Fulcher

(10) Patent No.: US 11,761,161 B2
(45) Date of Patent: Sep. 19, 2023

(54) RETAINING WALL EXTENSION SYSTEMS AND METHODS

(71) Applicant: Precast Concrete Concepts, LLC., Lewisville, NC (US)

(72) Inventor: Nelson T. Fulcher, Lewisville, NC (US)

(73) Assignee: Precast Concrete Concepts, LLC., Lewisville, NC (US)

( * ) Notice: Subject to any disclaimer, the term of this patent is extended or adjusted under 35 U.S.C. 154(b) by 0 days.

(21) Appl. No.: 17/679,476

(22) Filed: Feb. 24, 2022

(65) Prior Publication Data

US 2023/0027874 A1 Jan. 26, 2023

Related U.S. Application Data

(60) Provisional application No. 63/203,428, filed on Jul. 22, 2021.

(51) Int. Cl.
*E02B 3/06* (2006.01)

(52) U.S. Cl.
CPC ..... *E02B 3/06* (2013.01)

(58) Field of Classification Search
CPC ..... E02B 3/06; E02D 29/02
See application file for complete search history.

(56) References Cited

U.S. PATENT DOCUMENTS 1,907,135 A * 5/1933 Wemlinger ..... E02B 3/066 405/285
5,471,811 A * 12/1995 House ..... E01F 15/0476 52/745.1

FOREIGN PATENT DOCUMENTS

| | | | |
|---|---|---|---|
| CA | 2806224 | * | 3/2014 |
| JP | 61014314 | * | 1/1986 |
| WO | WO 2011031177 | * | 3/2011 |

* cited by examiner

*Primary Examiner* — Sean D Andrish
(74) *Attorney, Agent, or Firm* — Womble Bond Dickinson (US) LLP

(57) ABSTRACT

A retaining wall extension system for extending a retaining wall, wherein the retaining wall includes an existing wall cap having an upper surface defining an elevation of the retaining wall, with the upper surface having a length and a width. The retaining wall extension system includes an extension cap arranged to be received by the existing wall cap of the retaining wall. The extension cap includes a first portion arranged to be received by the upper surface of the existing wall cap, and a second portion integrally formed with the first portion, wherein the second portion extends vertically upward from the first portion so as to extend the elevation of the retaining wall. A method of extending a retaining wall is also provided.

20 Claims, 10 Drawing Sheets

RETAINING WALL EXTENSION SYSTEMS AND METHODS

CROSS-REFERENCE TO RELATED APPLICATIONS

Figure 1A:
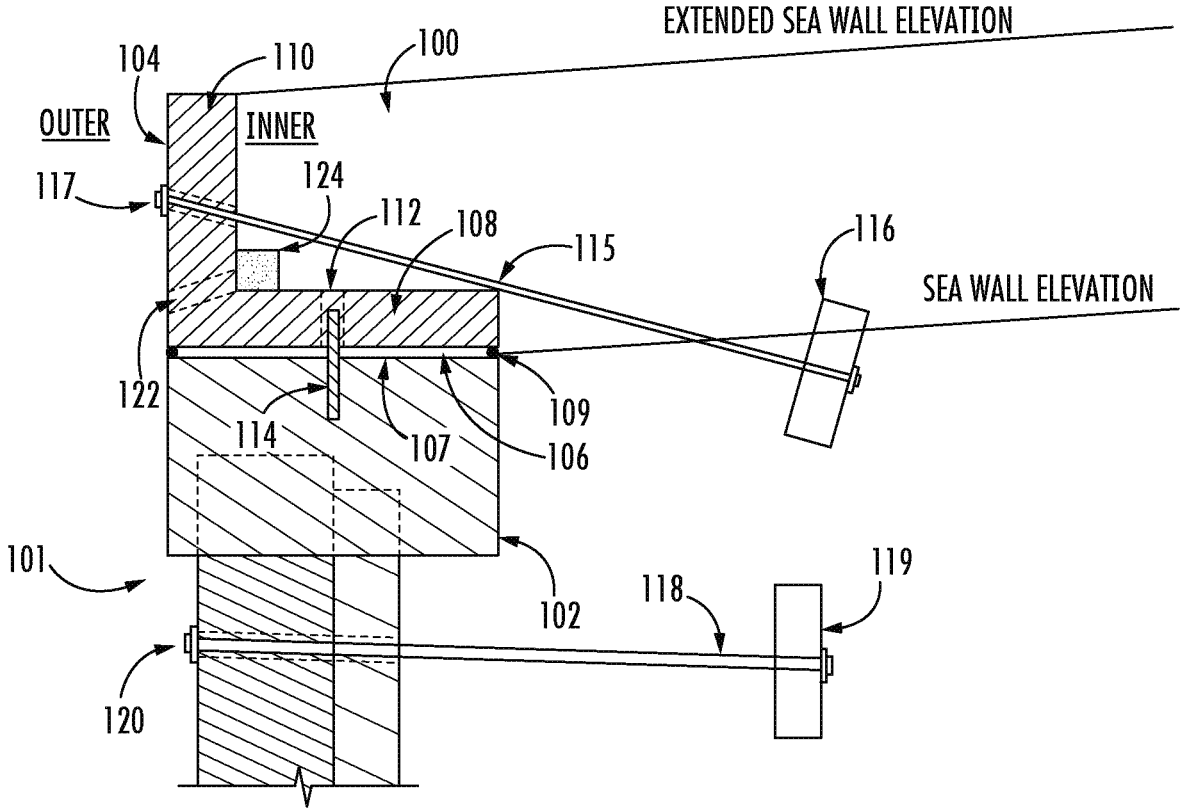

This application claims priority to U.S. Provisional Patent Application No. 63/203,428, filed Jul. 22, 2021, which is incorporated herein by reference in its entirety and for all purposes.

BACKGROUND

Field of the Disclosure

The present disclosure relates to retaining wall systems. More particularly, the present disclosure relates to retaining wall systems including an extension cap for extending an elevation of an existing retaining wall.

Description of Related Art

As a consequence of climate change and other factors, ocean water levels are rising around the world. According to the National Oceanic and Atmospheric Association (NOAA), almost 40% of the U.S. population lives in an area that may be vulnerable to sea level rise. In 2012, NOAA scientists reviewed the research on global sea level rise projections. The scientists concluded that even at the lowest possible greenhouse gas emission scenarios, global mean sea level would rise at least 8 inches (0.2 meters) above 1992 levels by 2100. In scenarios with high rates of emissions, sea level rise would be substantially higher, but the scientists appeared to agree that sea level rises was unlikely to exceed 6.6 feet higher than 1992 levels. In 2017, the U.S. Interagency Sea Level Rise Taskforce revised both the low-end and "worst-case" possibilities upward after additional review. Based on updated scenarios, global sea levels are likely to rise at least 12 inches (0.3 meters) above 2000 levels by 2100 even in a low-emissions scenario. In scenarios with the highest greenhouse gas emissions, sea level rise could be as high as 8.2 feet (2.5 meters) above 2000 levels by 2100.

In order to prevent or minimize damage to homes and communities due to this expected sea level rise, new seawalls will need to be constructed and existing seawalls and other retaining walls will need to be altered to account for the higher sea level. However, altering an existing seawall can be financially costly, dangerous, and time consuming. Thus there exists a need to address the issue of extending the height/elevation of existing retaining walls such as seawalls in a timelier, structurally sound, safe, and budget friendly manner.

SUMMARY

The above and other needs are met by aspects of the present disclosure which includes, without limitation, the following example embodiments and, in one particular aspect, provides a retaining wall extension system for extending a retaining wall (i.e., extending or increasing the height of the retaining wall), wherein the retaining wall includes an existing wall cap having an upper surface defining an elevation of the retaining wall, with the upper surface having a length and a width. The retaining wall extension system comprises an extension cap arranged to be received by the existing wall cap of the retaining wall. The extension cap comprises a first portion arranged to be received by the upper surface of the existing wall cap, and a second portion integrally formed with the first portion. The second portion extends vertically upward from the first portion so as to extend the elevation of the retaining wall.

Another aspect of the present disclosure provides a method of extending a retaining wall (i.e., extending or increasing a height of the retaining wall), wherein the retaining wall includes an existing wall cap having an upper surface defining an elevation of the retaining wall, with the upper surface having a length and a width. Such a method comprises engaging an extension cap with the existing wall cap of the retaining wall, with the extension cap comprising a first portion arranged to be received by the upper surface of the existing wall cap and a second portion integrally formed with the first portion and extending vertically upward from the first portion, so as to extend the elevation of the retaining wall.

The present disclosure thus includes, without limitation, the following example embodiments:

Example Embodiment 1: A retaining wall extension system for extending a retaining wall, the retaining wall including an existing wall cap having an upper surface defining an elevation of the retaining wall, the upper surface having a length and a width, the retaining wall extension system comprising an extension cap arranged to be received by the existing wall cap of the retaining wall, the extension cap comprising: a first portion arranged to be received by the upper surface of the existing wall cap; and a second portion integrally formed with the first portion, the second portion extending vertically upward from the first portion so as to extend the elevation of the retaining wall.

Example Embodiment 2: The retaining wall extension system of any preceding embodiment, or combinations thereof, comprising an adhesive material disposed at least between the first portion and the upper surface of the existing wall cap to secure the extension cap thereto.

Example Embodiment 3: The retaining wall extension system of any preceding embodiment, or combinations thereof, comprising a spacer arranged to space the first portion from the upper surface of the existing wall cap so as to define a gap therebetween for receiving the adhesive material therein to secure the first portion to the existing wall cap.

Example Embodiment 4: The retaining wall extension system of any preceding embodiment, or combinations thereof, wherein the first portion includes an upper surface and a lower surface, and defines a plurality of holes each extending therethrough, the holes being arranged to receive a reinforcing bar through the lower surface of the first portion, the reinforcing bar being engaged with and extending from the upper surface of the existing wall cap, and to receive the adhesive material through the upper surface of the first portion, the adhesive material being arranged to interact between the first portion and the reinforcing bars within the holes to secure the first portion to the existing wall cap.

Example Embodiment 5: The retaining wall extension system of any preceding embodiment, or combinations thereof, wherein the adhesive material is a grout material, an ultra-high performance concrete material, or an epoxy material.

Example Embodiment 6: The retaining wall extension system of any preceding embodiment, or combinations thereof, wherein the extension cap is comprised of a concrete material, one or more composite materials, or recycled plastics material.

Example Embodiment 7: The retaining wall extension system of any preceding embodiment, or combinations thereof, wherein the extension cap is formed by casting prior to being received by the existing wall cap or formed by casting in place on the existing wall cap.

Example Embodiment 8: The retaining wall extension system of any preceding embodiment, or combinations thereof, wherein the existing wall cap has an inner-facing surface and an outer-facing surface, and the extension cap comprises a third portion integrally formed with the first portion, the third portion extending downward from the first portion along the outer-facing surface of the existing wall cap.

Example Embodiment 9: The retaining wall extension system of any preceding embodiment, or combinations thereof, wherein the third portion includes an outer surface and an inner surface, and defines a plurality of holes each extending therethrough, one or more of the holes being arranged to receive a reinforcing bar engaged with and extending from the outer-facing surface of the existing wall cap, and to receive the adhesive material through the outer surface of the third portion, the adhesive material being arranged to interact between the third portion and the reinforcing bars within the one or more of the holes to secure the third portion to the outer-facing surface of the existing wall cap.

Example Embodiment 10: The retaining wall extension system of any preceding embodiment, or combinations thereof, wherein the extension cap comprises a fourth portion integrally formed with the first portion, the fourth portion extending downward from the first portion along the inner-facing surface of the existing wall cap.

Example Embodiment 11: The retaining wall extension system of any preceding embodiment, or combinations thereof, wherein the fourth portion includes an outer surface and an inner surface, and defines a plurality of holes each extending therethrough, one or more of the holes being arranged to receive a reinforcing bar engaged with and extending from the inner-facing surface of the existing wall cap, and to receive the adhesive material through the outer surface of the fourth portion, the adhesive material being arranged to interact between the fourth portion and the reinforcing bars within the one or more of the holes to secure the fourth portion to the inner-facing surface of the existing wall cap.

Example Embodiment 12: The retaining wall extension system of any preceding embodiment, or combinations thereof, wherein the existing wall cap has an inner-facing surface and an outer-facing surface, and wherein the second portion extends vertically upward from the first portion adjacent to the outer-facing surface of the existing wall cap.

Example Embodiment 13: The retaining wall extension system of any preceding embodiment, or combinations thereof, wherein the second portion defines one or more drainage holes extending therethrough, the one or more drainage holes being disposed toward the first portion.

Example Embodiment 14: The retaining wall extension system of any preceding embodiment, or combinations thereof, wherein the existing wall cap has an inner-facing surface and an outer-facing surface, and wherein the system comprises one or more securing devices each including a tether portion engaged with and extending from the second portion inwardly past the inner-facing surface of the existing wall cap to an anchor portion.

Example Embodiment 15: The retaining wall extension system of any preceding embodiment, or combinations thereof, wherein the anchor portion comprises a deadman or a helical anchor, and wherein the tether portion comprises a cable or a tie rod.

Example Embodiment 16: A method of extending a retaining wall, the retaining wall including an existing wall cap having an upper surface defining an elevation of the retaining wall, the upper surface having a length and a width, the method comprising engaging an extension cap with the existing wall cap of the retaining wall, the extension cap comprising a first portion arranged to be received by the upper surface of the existing wall cap and a second portion integrally formed with the first portion and extending vertically upward from the first portion, so as to extend the elevation of the retaining wall.

Example Embodiment 17: The method of any preceding embodiment, or combinations thereof, comprising disposing an adhesive material at least between the first portion and the upper surface of the existing wall cap to secure the extension cap thereto.

Example Embodiment 18: The method of any preceding embodiment, or combinations thereof, comprising arranging a spacer between the first portion and the upper surface of the existing wall cap so as to define a gap therebetween, wherein disposing an adhesive material comprises disposing the adhesive material within the gap to secure the first portion to the existing wall cap.

Example Embodiment 19: The method of any preceding embodiment, or combinations thereof, wherein the first portion includes an upper surface and a lower surface, and defines a plurality of holes each extending therethrough, and wherein the method comprises:

receiving a reinforcing bar in one or more of the holes through the lower surface of the first portion, the reinforcing bar being engaged with and extending from the upper surface of the existing wall cap; and receiving the adhesive material through the upper surface of the first portion such that the adhesive material interacts between the first portion and the reinforcing bars within the one or more of the holes to secure the first portion to the existing wall cap.

Example Embodiment 20: The method of any preceding embodiment, or combinations thereof, wherein disposing the adhesive material comprises disposing a grout material, an ultra-high performance concrete material, or an epoxy material at least between the first portion and the upper surface of the existing wall cap.

Example Embodiment 21: The method of any preceding embodiment, or combinations thereof, wherein the extension cap is comprised of a concrete material, one or more composite materials, or recycled plastics material, and wherein the method comprises forming the extension cap by casting the concrete material prior to being received by the existing wall cap, or forming the extension cap by casting the concrete material in place on the existing wall cap.

Example Embodiment 22: The method of any preceding embodiment, or combinations thereof, wherein the existing wall cap has an inner-facing surface and an outer-facing surface, and the extension cap comprises a third portion integrally formed with the first portion and extends downward therefrom, and wherein engaging the extension cap comprises engaging the extension cap with the existing wall cap such that the third portion extends along the outer-facing surface of the existing wall cap.

Example Embodiment 23: The method of any preceding embodiment, or combinations thereof, wherein the third portion includes an outer surface and an inner surface, and defines a plurality of holes each extending therethrough, and wherein the method comprises receiving a reinforcing bar in one or more of the holes, the reinforcing bar being engaged with and extending from the outer-facing surface of the existing wall cap; and receiving the adhesive material in the one or more of the holes through the outer surface of the third portion, such that the adhesive material interacts between the third portion and the reinforcing bars within the one or more of the holes to secure the third portion to the outer-facing surface of the existing wall cap.

Example Embodiment 24: The method of any preceding embodiment, or combinations thereof, wherein the extension cap comprises a fourth portion integrally formed with the first portion, and wherein engaging the extension cap comprises engaging the extension cap with the existing wall cap such that the fourth portion extends along the inner-facing surface of the existing wall cap.

Example Embodiment 25: The method of any preceding embodiment, or combinations thereof, wherein the fourth portion includes an outer surface and an inner surface, and defines a plurality of holes each extending therethrough, and wherein the method comprises receiving a reinforcing bar in one or more of the holes, the reinforcing bar being engaged with and extending from the inner-facing surface of the existing wall cap; and receiving the adhesive material in the one or more of the holes through the outer surface of the fourth portion, such that the adhesive material interacts between the fourth portion and the reinforcing bars within the one or more of the holes to secure the fourth portion to the inner-facing surface of the existing wall cap.

Example Embodiment 26: The method of any preceding embodiment, or combinations thereof, wherein the existing wall cap has an inner-facing surface and an outer-facing surface, wherein engaging the extension cap comprises engaging the extension cap with the existing wall cap such that the second portion extends vertically upward from the first portion adjacent to the outer-facing surface of the existing wall cap.

Example Embodiment 27: The method of any preceding embodiment, or combinations thereof, comprising forming one or more drainage holes in the second portion and extending therethrough, with the one or more drainage holes being disposed toward the first portion.

Example Embodiment 28: The method of any preceding embodiment, or combinations thereof, wherein the existing wall cap has an inner-facing surface and an outer-facing surface, and wherein the method comprises engaging one or more securing devices with the second portion, each securing device including a tether portion comprising a cable or a tie rod engaged with and extending from the second portion inwardly past the inner-facing surface of the existing wall cap to an anchor portion comprising a deadman or a helical anchor.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

It will be appreciated that the summary herein is provided merely for purposes of summarizing some example aspects so as to provide a basic understanding of the disclosure. As such, it will be appreciated that the above described example aspects are merely examples and should not be construed to narrow the scope or spirit of the disclosure in any way. It will be appreciated that the scope of the disclosure encompasses many potential aspects, some of which will be further described below, in addition to those herein summarized. Further, other aspects and advantages of such aspects disclosed herein will become apparent from the following detailed description taken in conjunction with the accompanying drawings which illustrate, by way of example, the principles of the described aspects.

BRIEF DESCRIPTION OF THE SEVERAL VIEWS OF THE DRAWING(S)

Figure 1B:
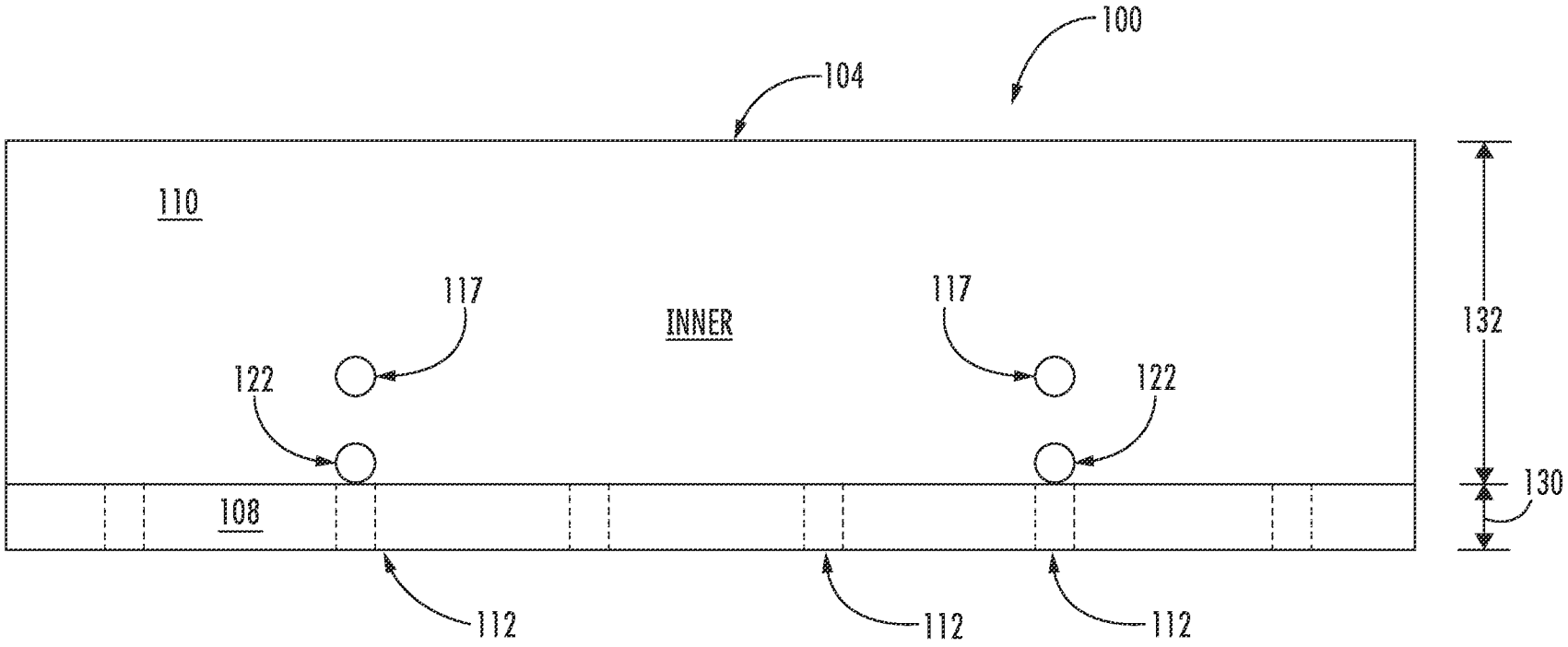
Figure 1C:
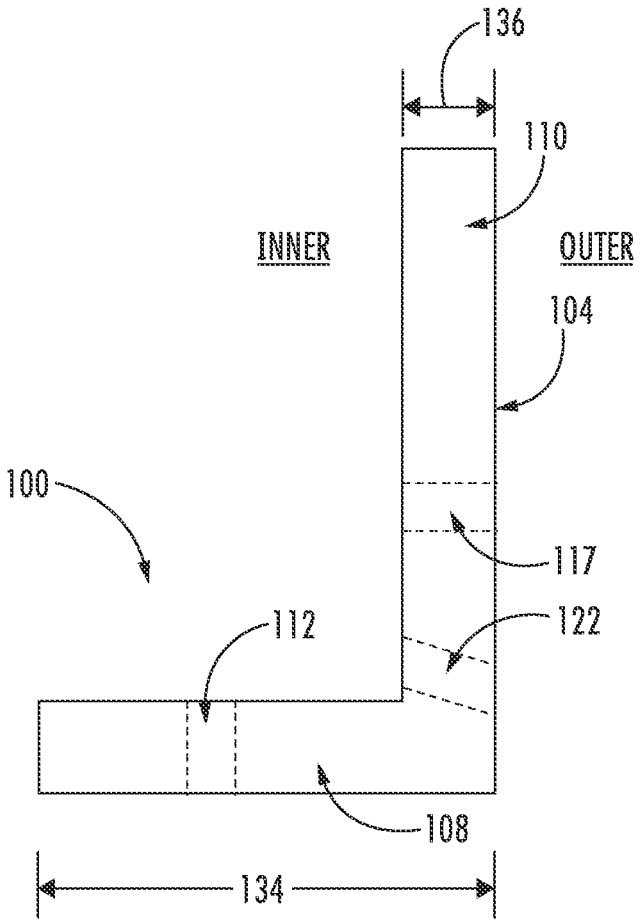
Figure 2A:
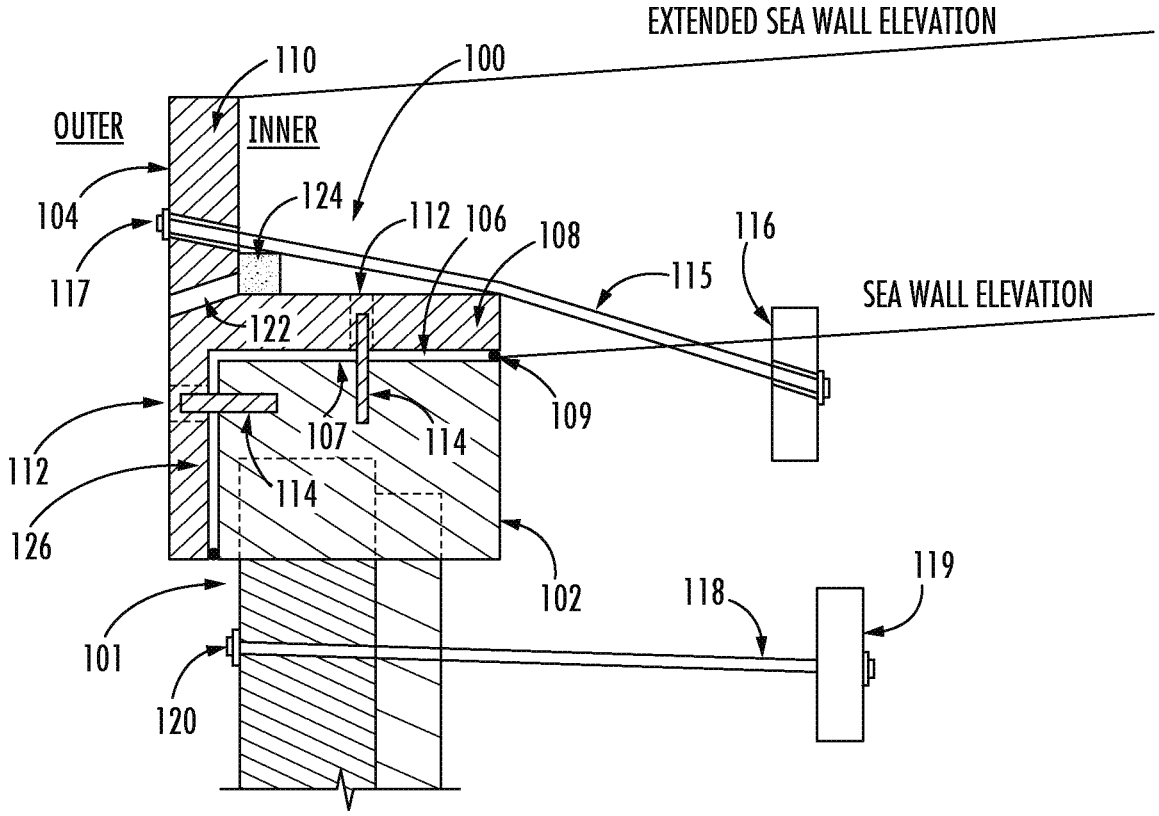
Figure 2B:
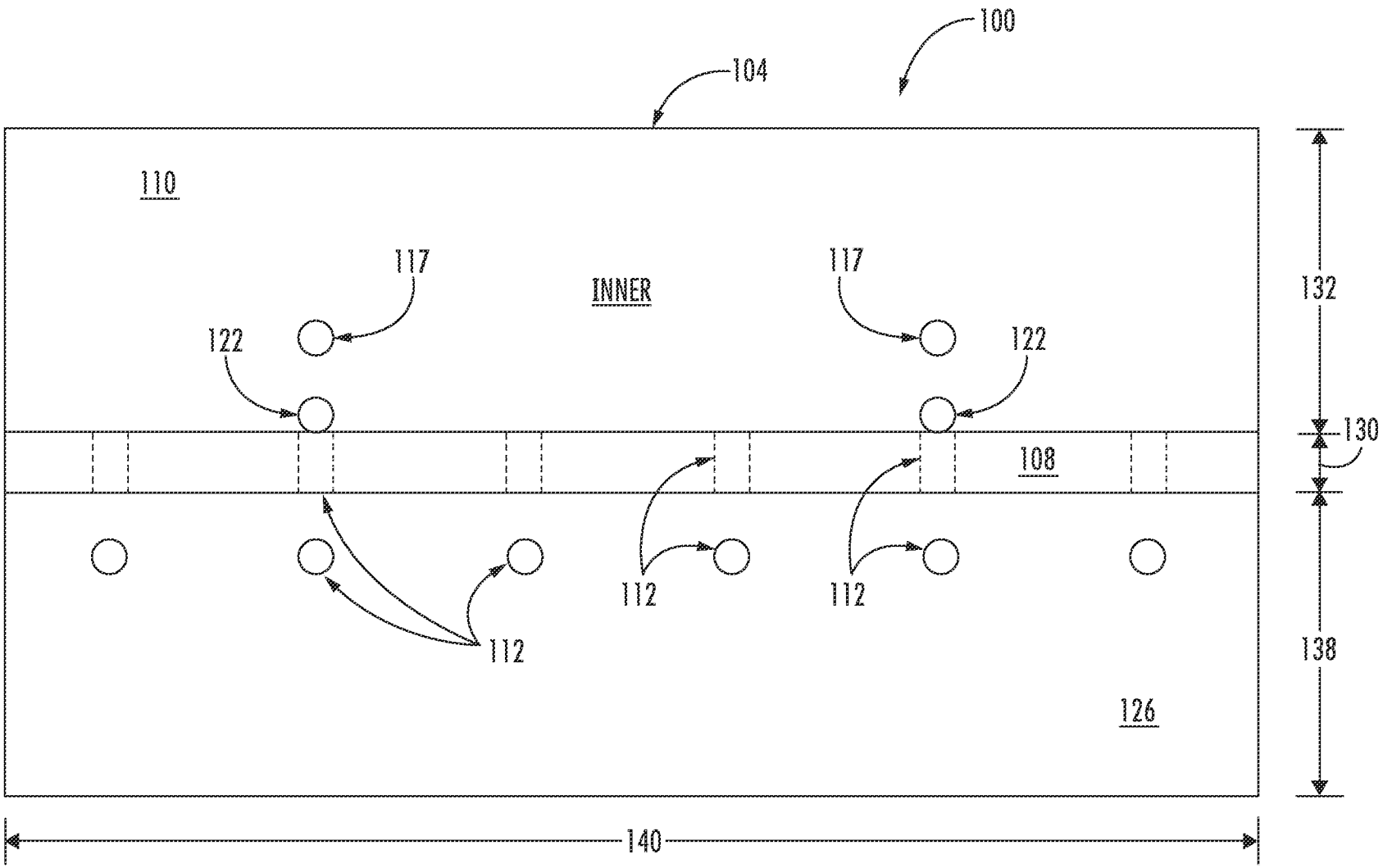
Figure 2C:
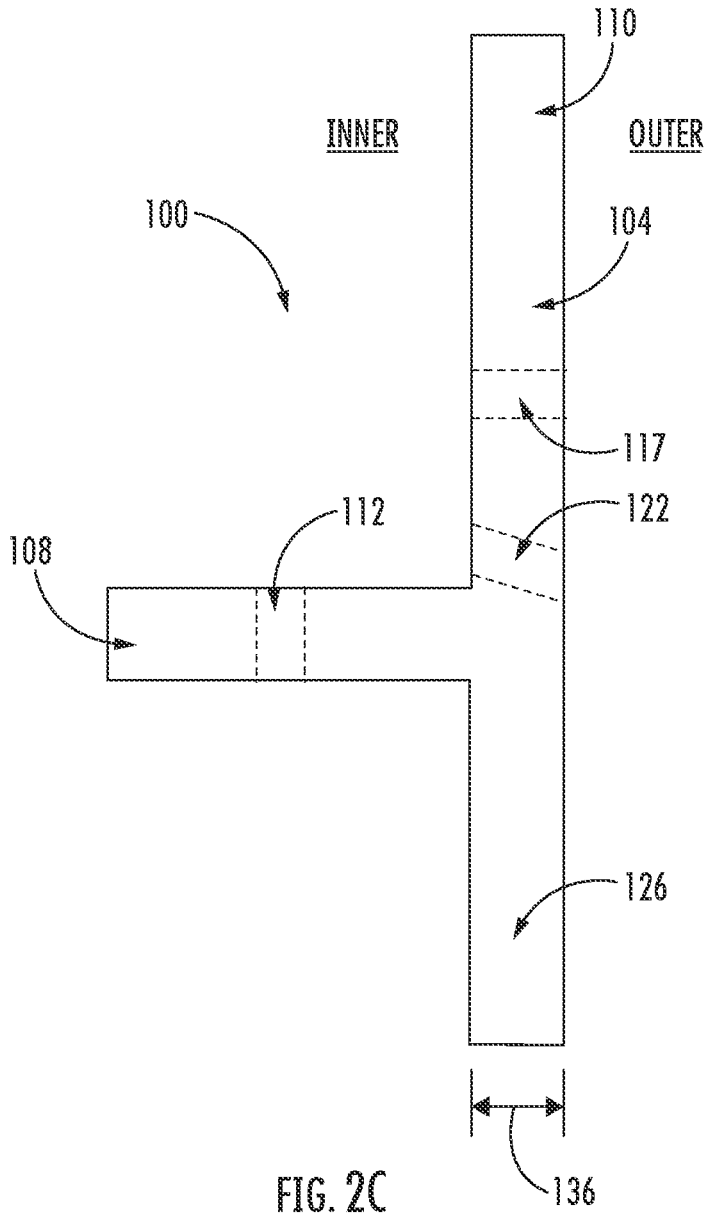
Figure 3A:
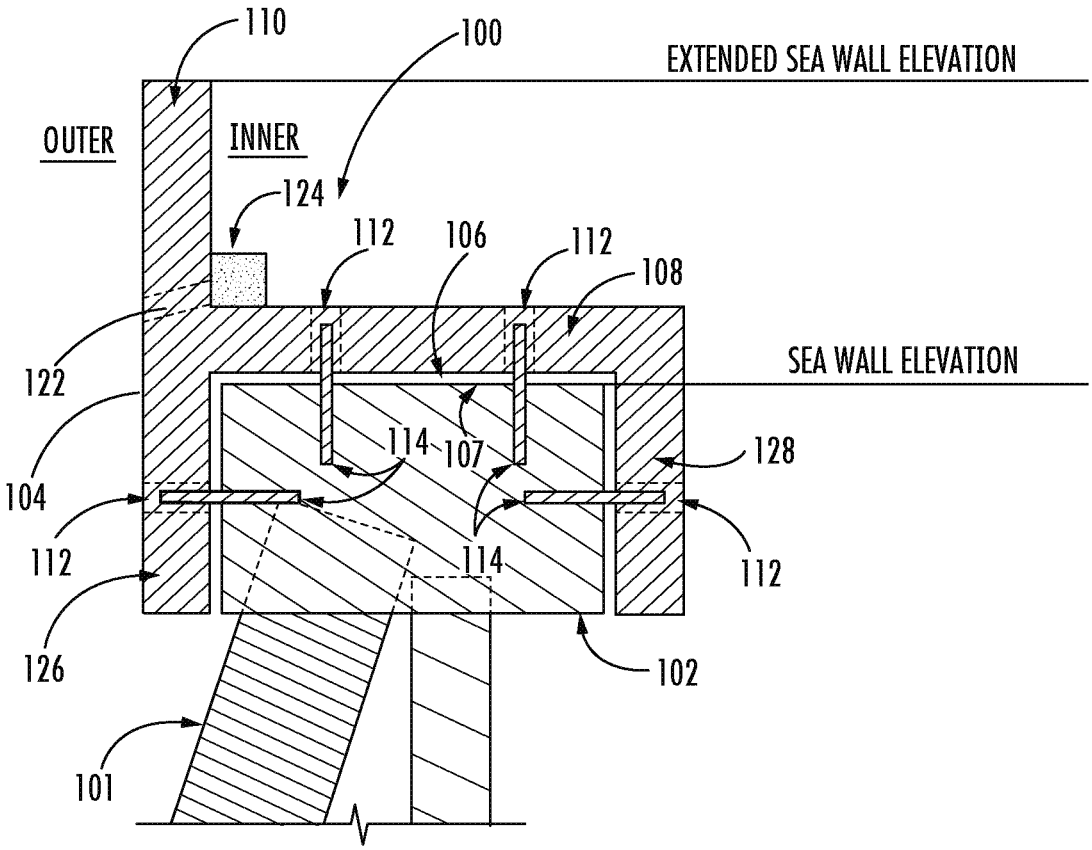
Figure 3B:
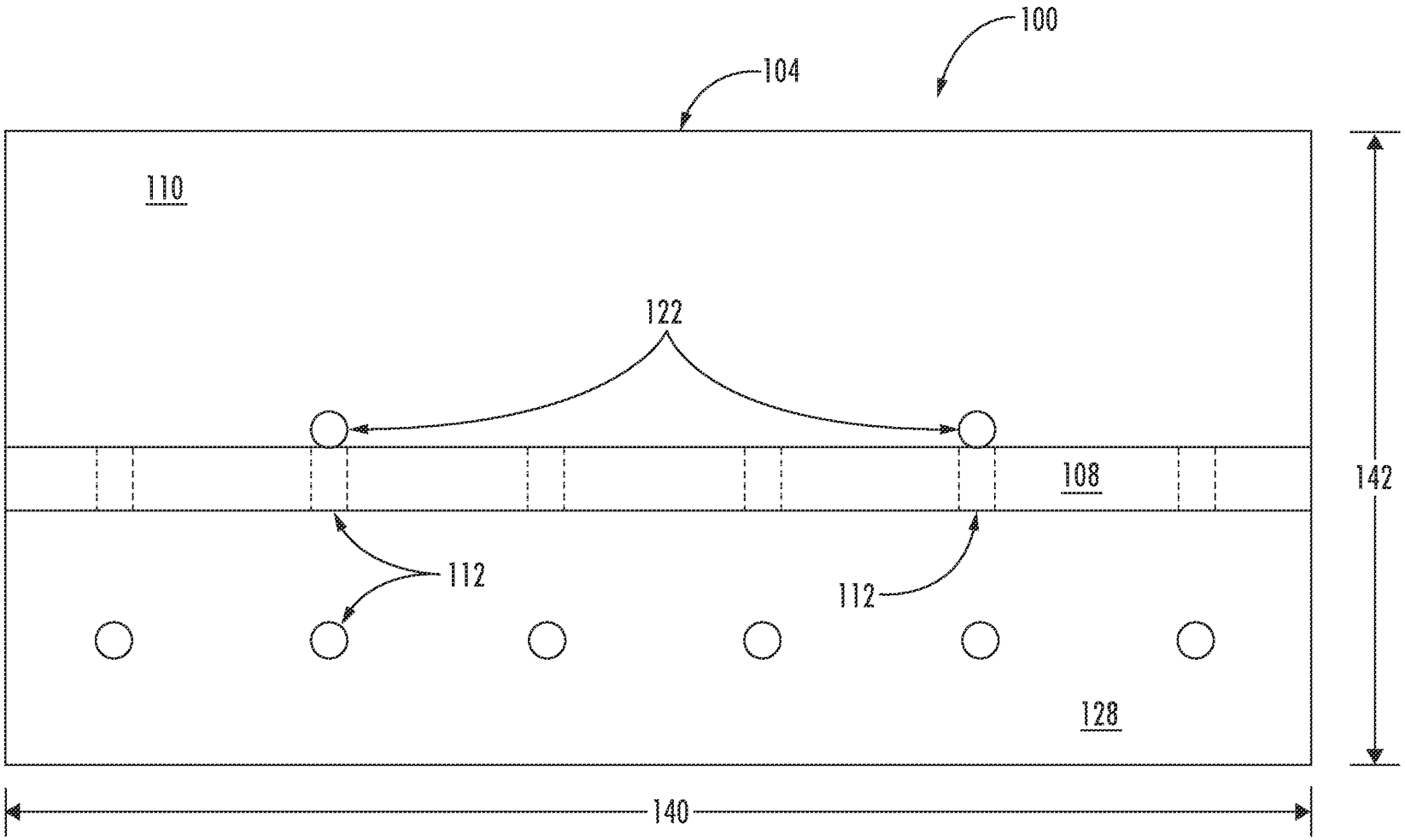
Figure 3C:
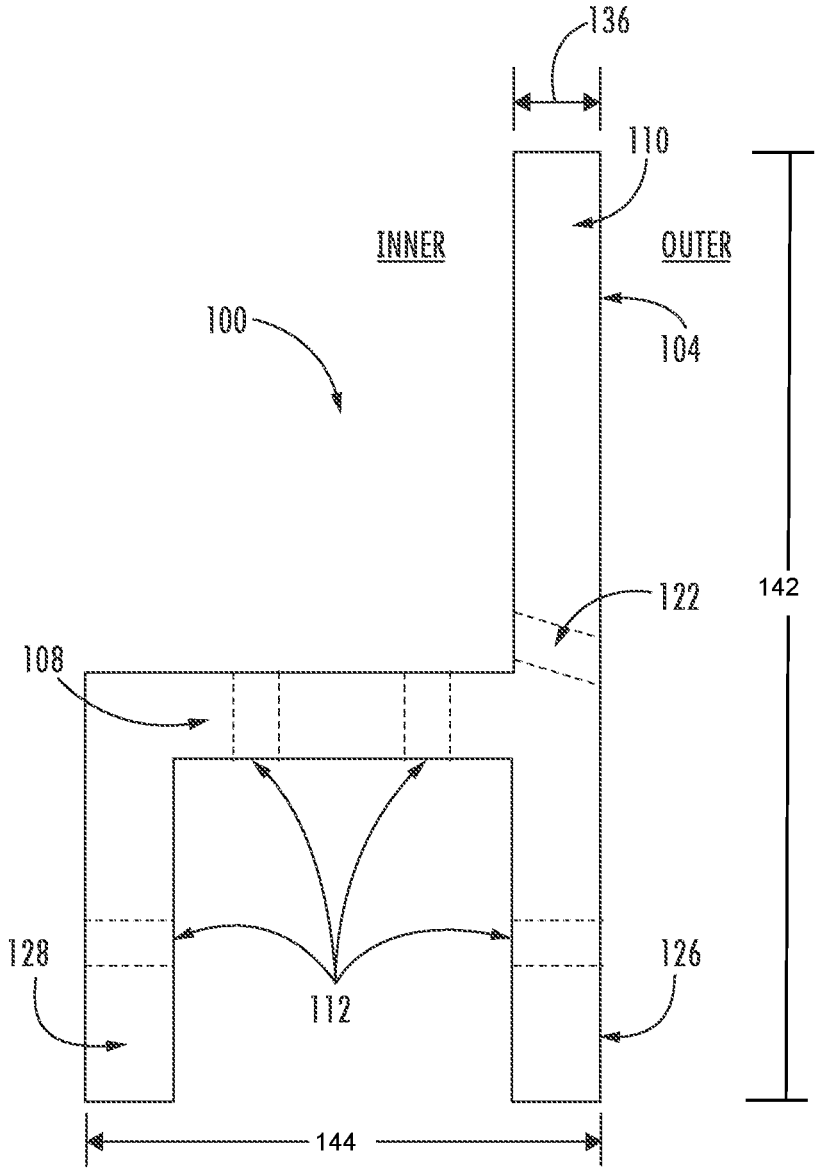
Figure 4:
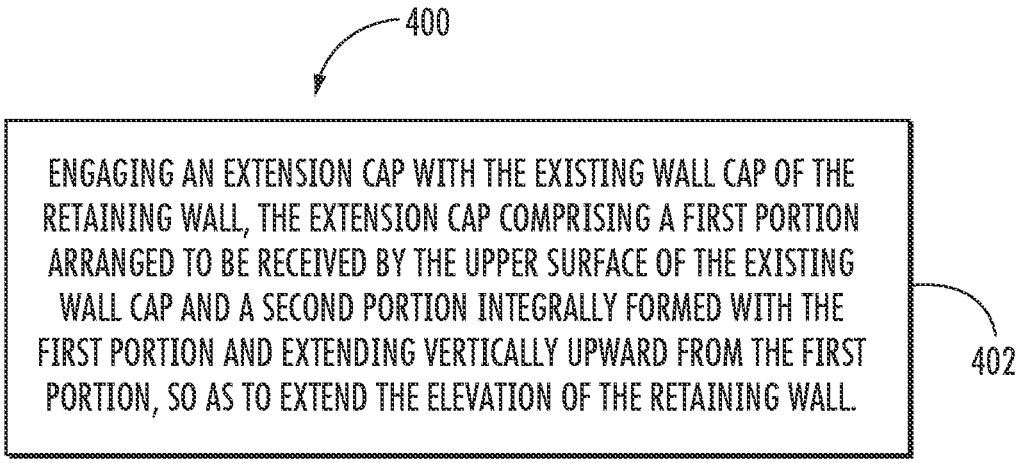

Having thus described the disclosure in general terms, reference will now be made to the accompanying drawings, which are not necessarily drawn to scale, and wherein:

FIGS. 1A-1C schematically illustrate a side cross-sectional view, rear view, and side view, respectively, of an example sea wall extension system, according to some embodiments of the present disclosure;

FIGS. 2A-2C schematically illustrate a side cross-sectional view, rear view, and side view, respectively, of an example sea wall extension system, according to another embodiment of the present disclosure;

FIGS. 3A-3C schematically illustrate a side cross-sectional view, rear view, and side view, respectively, of an example sea wall extension system, according to yet another embodiment of the present disclosure; and FIG. 4 schematically illustrates a flow chart of an example method for extending a retaining wall, according to some embodiments of the present disclosure.

DETAILED DESCRIPTION

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

FIG. 1A illustrates a side cross-sectional view of an example retaining wall extension system 100, according to some embodiments of the present disclosure. The retaining wall extension system 100 can be used, for example, for extending (i.e., extending a height or elevation of) an existing retaining wall 101, such as a sea wall. Such a retaining wall 101 generally including an existing wall cap 102 having an upper surface 107 defining an elevation of the existing retaining wall, with the upper surface 107 having a length and a width. In some instances, the existing wall cap 102 is comprised of a concrete material, one or more composite materials, or recycled plastics material. In some embodiments, the retaining wall extension system 100 comprises an extension cap 104 arranged to be received by the existing wall cap 102 of the retaining wall 101. Like the existing wall cap 102, the extension cap 104 can be comprised of a concrete material, one or more composite materials, or recycled plastics material. In some embodiments, the extension cap 104 comprises a first portion 108 and a second portion 110. The first portion 108 is arranged to be received by the upper surface 107 of the existing wall cap 102. The second portion 110 is integrally formed with the first portion 108, and extends vertically upward from the first portion 108 so as to extend the elevation of the existing retaining wall 101 to an extended retaining wall elevation as illustrated in FIG. 1A. In some instances, the extended retaining wall elevation is between about 1 foot and about 10 feet above the existing retaining wall elevation. For example, in some embodiments, the extended retaining wall elevation is about 2 feet or about 6 feet above the existing retaining wall elevation.

In some embodiments, the retaining wall extension system 100 further comprises an adhesive material disposed at least between the first portion 108 and the upper surface 107 of the existing wall cap 102 to secure the extension cap 104 thereto. In some embodiments, the retaining wall extension system 100 comprises a spacer 109 arranged to space the first portion 108 from the upper surface 107 of the existing wall cap 102 so as to define a gap 106 therebetween for receiving the adhesive material therein to secure the first portion 108 to the existing wall cap 102. In some embodiments, the gap 106 is between about 0.25 inch and 1 inch. For example, and without limitation, the gap 106 is about 0.5 inch. In some embodiments, the adhesive material comprises a grout material. In some cases, the grout material can be a 10,000 psi grout material. In some other cases, the grout material can be a high-strength non-shrink grout material. In some cases, the adhesive material can by an ultra-high performance concrete material having compressive strengths of up to 29,000 psi. In some cases, the adhesive material can be an epoxy material.

In some embodiments, the first portion 108 of the extension cap 104 includes an upper surface and a lower surface, the lower surface of the first portion 108 facing the upper surface 107 of the existing wall cap 102 and the upper surface of the first portion 108 facing opposite the lower surface of the first portion 108. The first portion 108 of the extension cap 104 further defines a plurality of holes 112 extending therethrough, each of the plurality of holes 112 being arranged to receive a corresponding reinforcing bar 114, the reinforcing bar extending from the upper surface 107 of the existing wall cap 102, through the lower surface of the first portion 108. In some embodiments, each of the plurality of holes 112 has a diameter of between about 1 and 3 inches. For example and without limitation, each of the plurality of holes 112 has a diameter of about 2 inches. In some embodiments, the reinforcing bar(s) 114 has a diameter of between about 0.5 and 2 inches. For example and without limitation, the reinforcing bar(s) 114 has a diameter of about 1 inch. The reinforcing bar(s) 114 can, in some cases, include fiber reinforced polymer (FRP) reinforcing bars, hot dipped galvanized steel reinforcing bars, or any other suitable reinforcing bar that will preferably not corrode from exposure to salt water.

The reinforcing bar(s) 114 is/are engaged with and extend from the upper surface 107 of the existing wall cap 102. Each of the reinforcing bars 114 and holes 112 can be spaced apart as required by the desired strength characteristics of the extension cap 104 and desired security of the attachment to the existing retaining wall 101. Furthermore, the reinforcing bars 114 can be anchored into the existing wall cap 102 using an epoxy material or other suitable adhesive. In some embodiments, the plurality of holes 112 is configured to receive the adhesive material (e.g., grout material) through the upper surface of the first portion 108, the adhesive material being arranged to interact between the first portion 108 defining the holes 112 and the reinforcing bars 114 within the holes 112 to secure the first portion 108 to the existing wall cap 102.

In some embodiments, the extension cap 104 can be formed by casting a concrete material (or one or more composite materials, or recycled plastics material), prior to the extension cap 104 being received by the existing wall cap 102. In other instances, the extension cap 104 is formed by casting a concrete material (or one or more composite materials, or recycled plastics material) in place on the existing wall cap 102.

When referred to herein, the terms "outer" or "outer-facing" indicate a direction facing toward OUTER in the drawings. In cases where the extension system disclosed herein is used for a seawall or other retaining wall separating land from water, "outer" refers to the side of the seawall or retaining wall facing the water. Conversely, when referring to the terms "inner" or "inner-facing", the present disclosure is indicating a direction facing toward INNER in the drawings (i.e., the side of the seawall or retaining wall facing toward the land).

As illustrated in FIG. 1A, in some embodiments, the existing wall cap 102 has an inner-facing surface and an outer-facing surface, wherein the second portion 110 extends vertically upward from the first portion 108 adjacent to the outer-facing surface of the existing wall cap 102. Furthermore, in some embodiments, the second portion 110 defines one or more drain holes 122 (e.g., weep holes) extending therethrough, the one or more drain holes 122 being disposed toward the first portion 108 (e.g., toward the intersection of the second portion 110 with the first portion 108). In some embodiments, the one or more drain holes 122 can have a diameter of between about 1 and 3 inches. For example and without limitation, each of the one or more drain holes 122 has a diameter of about 2 inches. In some embodiments, a stone beam 124 for facilitating water drainage can be placed along an inner-face of the extension cap 104 adjacent to the drain holes 122. In some cases, the stone beam 124 can comprise, for example, #57 stone gravel, ¾" stone gravel wrapped in filter fabric, or other suitable materials to facilitate water draining through the drain holes 122.

As illustrated in FIG. 1A, the existing retaining wall 101 can include one or more securing devices each including a tether portion 118 engaged with and extending from an anchor portion 119 to a retaining wall fastener 120 engaged with the existing retaining wall 101. The securing device is configured and arranged to secure the land side of the retaining wall 101 to the land.

Furthermore, in some embodiments, the retaining wall extension system 100 comprises one or more securing devices, each including a tether portion 115 engaged with (i.e., at fastener 117) and extending from the second portion 110 inwardly past the inner-facing surface of the existing wall cap 102 to an anchor portion 116. The anchor portion 116 can comprise a deadman or a helical anchor, and the tether portion 115 can comprise a cable or a tie rod.

FIG. 1B illustrates a rear view (i.e., facing the inner surface) of the retaining wall extension system 100 of FIG. 1A, specifically, just the extension cap 104 of the system 100. This view illustrates the extension cap 104 from a perspective facing the inner-surface of the extension cap 104. As illustrated in FIG. 1B, a thickness 130 of the first portion 108 can be between about 4 inches and about 10 inches. For example and without limitation, the thickness 130 of the first portion 108 is about 6 inches. In some embodiments, the height or elevation 132 of the second portion 110 can vary based on the requirements of the location where the extension cap 104 is being installed as well as the physical characteristics of the extension cap 104. In some embodiments, for example, the height/elevation 132 of the second portion 110 can be between about 1 foot and about 10 feet. For example and without limitation, the height 132 of the second portion 110 is about 2 feet or 6 feet (i.e., including the thickness 130 of the first portion 108).

FIG. 1C illustrates a side or cross-sectional view of the retaining wall extension system 100 of FIG. 1A, specifically, just the extension cap 104 of the system 100. As illustrated in FIG. 1C, a width 134 of the first 108, measured as the distance that the first portion 108 extends from the second portion 110 plus the thickness 136 of the second portion 110, can vary based on the size of the existing wall cap 102 receiving the extension cap 104. For example, if the existing wall cap 102 is two feet wide, measured as the distance from the outer face of the wall cap 102 facing the water to the inner face of the wall cap 102 opposite the outer face, then the width 134 of the first portion 108 will be at least 2 feet. In some embodiments, the width 134 of the first portion 108 is between about 1 foot and about 6 feet. Just like the thickness 130 of the first portion 108, in some embodiments, the thickness 136 of the second portion 110 is between about 4 inches and about 10 inches. For example and without limitation, the thickness 136 of the second portion 110 is about 6 inches. In some embodiments, the thickness 130 of the first portion 108 is equal to, less than, or greater than the thickness 136 of the second portion.

As illustrated in FIG. 1C, in some embodiments, the first portion 108 and second portion 110 can form an "L" shaped (in cross section or end view) extension cap 104 to help "raise" or increase the effective height/elevation of the existing retaining wall 101 and wall cap 102.

FIG. 2A illustrates a side cross-sectional view of another embodiment of the retaining wall extension system 100 of the present disclosure. As illustrated in FIG. 2A, in some embodiments, the existing wall cap 102 has an inner-facing surface and an outer-facing surface, and the extension cap 104 comprises a third portion 126 integrally formed with the first portion 108. The third portion 126 extends downward from the first portion 108 along the outer-facing surface of the existing wall cap 102.

In some embodiments, the third portion 126 includes an outer surface and an inner surface, and defines a plurality of holes 112 each extending therethrough. In some cases, one or more of the holes 112 is arranged to receive a reinforcing bar 114 engaged with and extending from the outer-facing surface of the existing wall cap 102, and to receive the adhesive material through the outer surface of the third portion 126. In such instances, the adhesive material is arranged to interact between the third portion 126 defining the one or more holes 112 and the reinforcing bars 114 within the one or more of the holes 112, to secure the third portion 126 to the outer-facing surface of the existing wall cap 102. In this embodiment, the hole 112 and reinforcing bar connecting the existing wall cap 102 to the first portion 108 are configured to also receive the adhesive material, as described above with respect to FIG. 1A.

As illustrated in FIG. 2A, the gap 106 in this embodiment is present between the upper surface of the existing wall cap 102 and the lower surface of the first portion 108 and follows along to the outer-facing surface of the existing wall cap 102 and is present between the inner-facing surface of the third portion 126 and the outer-facing surface of the existing wall cap 102. The dimensions of the gap 106 are as previously disclosed herein.

Similar to the embodiment described with respect to FIG. 1A, the embodiment of the retaining wall extension system 100 illustrated in FIG. 2A comprises one or more securing devices each including a tether portion 115 engaged with (i.e., at fastener 117) and extending from the second portion 110 inwardly past the inner-facing surface of the existing wall cap 102 to an anchor portion 116. The anchor portion 116 can comprise a deadman or a helical anchor, and the tether portion 115 can comprise a cable or a tie rod.

FIG. 2B illustrates a rear view (i.e., facing the inner surface) of the extension cap 104 described in FIG. 2A. As disclosed herein, in some embodiments, a thickness 130 of the first portion 108 can be between about 4 inches and about 10 inches. For example and without limitation, the thickness 130 of the first portion 108 is about 6 inches. In some embodiments, the height/elevation 132 of the second portion 110 can vary based on the requirements of the location where the extension cap 104 is being installed and/or the structural limitations of the existing retaining wall 101. In some embodiments, for example, the height/elevation 132 of the second portion 110 can be between about 4 feet and about 10 feet. For example and without limitation, the height/elevation 132 of the second portion 110 is about 6 feet (i.e., including the thickness 130 of the first portion 108).

Additionally, a vertical dimension 138 that the third portion 126 extends downward below the existing retaining wall elevation along the outer-facing surface of the existing wall cap 102 varies based on the height dimension of the outer-facing surface of the existing wall cap 102. In some embodiments, the vertical dimension 138 is equal to, less than, or greater than the height dimension of the outer-facing surface of the existing wall cap 102.

As discussed herein, the extension cap 104 can be formed by casting prior to being received by the existing wall cap or formed by casting in place on the existing wall cap 102. In either case, the extension cap 104 as applied to the existing retaining wall 101 can be formed as discrete, individual (lengthwise) sections. For example and without limitation, if there is an existing retaining wall 101 that is 120 feet long, the existing retaining wall 101 can be extended in elevation by installing ten 12 foot long discrete sections or portions of the extension cap 104. That is, whether the extension cap 104 is cast before installing (i.e., precast) or cast in place (i.e., by casting in place on the existing retaining wall 101), the extension cap 104 sections or portions can have a length 140 of any suitable distance. For example and without limitation, each extension cap 104 section can have a length 140 of between about 6 feet and about 20 feet. For example and without limitation, each extension cap 104 section/portion has a length 140 of about 12 feet.

To extend the height/elevation of the existing retaining wall 101, a series of extension cap 104 sections/portions can be connected together, sealed or unsealed (i.e., at each connection point), along the length of the existing wall cap 102. In some cases, only a portion of an existing retaining wall 101 may need to be raised in elevation, in which case only one or more sections/portions of an extension cap 104 may be needed. However, in other situations, a longer length of existing retaining wall 101 may need to be raised, in which case, a plurality of sections/portions of extension caps 104 is needed. The number and lengths of sections/portions of extension caps 104 needed will depend on many variables as every retaining wall has its own requirements (e.g., length of the retaining wall, condition of current retaining wall, height of the water at certain locations along the retaining wall, etc.).

FIG. 2C illustrates a side view of the example extension cap 104 of the retaining wall extension system 100 disclosed in FIG. 2A. Similar to the embodiment described with respect to FIG. 1C, the second portion 110, and therefore the third portion 126, can have the same thickness 136 as described above. However, in some other embodiments, the second portion 110 can have a thickness 136 that is greater than or less than the thickness 136 of the third portion 126. As illustrated in FIG. 2C, in some embodiments, the first portion 108, second portion 110, and third portion 126 can form a "T" shaped (cross-section or end view) extension cap 104 to help "raise" or increase the effective height/elevation of the existing retaining wall 101 and wall cap 102.

FIG. 3A illustrates a side cross-sectional view of yet another example retaining wall extension system 100 according to some embodiments of the present disclosure. In this example embodiment, the extension cap 104 comprises a fourth portion 128 integrally formed with the first portion 108, the fourth portion 128 extending downward from the first portion 108 along the inner-facing surface of the existing wall cap 102. Furthermore, the fourth portion 128 includes an outer surface and an inner surface, and defines a plurality of holes 112 each extending therethrough. In some embodiments, one or more of the holes 112 is arranged to receive a reinforcing bar 114 engaged with and extending from the inner-facing surface of the existing wall cap 102, and to receive an adhesive material (e.g., the grout material or other suitable adhesive disclosed hereinabove) through the outer surface of the fourth portion 128. The adhesive material is arranged to interact between the fourth portion 128 defining the one or more holes 112 and the reinforcing bars 114 within the one or more of the holes 112 to secure the fourth portion 128 to the inner-facing surface of the existing wall cap 102. As disclosed above with respect to FIG. 1A and FIG. 2A, the first portion 108 and/or the third portion 126 of the embodiment illustrated in FIG. 3A can also be secured to the existing wall cap via one or more holes 112, the reinforcing bars 114, and the adhesive material.

As illustrated in FIG. 3A, the gap 106 in this embodiment is present between the upper surface of the existing wall cap 102 and the lower surface of the first portion 108. Furthermore, the gap 106 extends along to the outer-facing surface of the existing wall cap 102 and the inner-facing surface of the existing wall cap 102. Accordingly, the gap 106 is also present between the inner-facing surface of the third portion 126 and the outer-facing surface of the existing wall cap 102, as well as between the inner-facing surface of the existing wall cap 102 and the outer-facing surface of the fourth portion 128. The dimension of the gap 106 is as disclosed above.

Similar to that described above with respect to FIGS. 1A and 2A, the embodiment of the retention wall extension system 100 of FIG. 3A can also include one or more securing devices.

FIG. 3B illustrates a rear view (i.e., facing the inner surface) of the extension cap 104 of FIG. 3A. Those having ordinary skill in the art will appreciate that the total height/elevation 142 of the extension cap 104 can vary based on the existing retaining wall 102 height and other factors. However, in many cases, the total height/elevation 142 from the top of the second portion 110 to the bottom of the third portion 126 or fourth portion 128 can be the height of the inner or outer-facing surface of the existing wall cap 102, plus the thickness of the first portion 108 and the height of the second portion 110 as disclosed hereinabove. In some embodiments, the total height 142 of the extension cap 104 can range between about 4 feet and about 10 feet. For example and without limitation, the total height 142 of the extension cap is about 9½ feet (i.e., about a 6 foot high second portion 110, about a 6 inch thick first portion 108, and about a 3 feet high third portion 126 or fourth portion 128).

FIG. 3C illustrates a side view of the extension cap 104 of FIG. 3A. As disclosed herein the thickness 136 of the second portion 110 and third portion 126 can be between about 4 inches and about 10 inches, for example, about 6 inches. Additionally, the first portion 108 and fourth portion 128 can also have a thickness of between about 4 inches and about 10 inches, for example, about 6 inches. However, the thickness of each portion may be different from each other, or the same, or two or more portions could have the same thickness with the other portion(s) having a different thickness than the other two portions. Thus, a total width 144 of the extension cap 104 of the embodiment illustrated in FIG. 3A-3C, can be the combined thicknesses of the fourth portion 128 and either the second portion 110 or third portion 126, depending on whichever is thicker, and the width of the existing wall cap 102 to which the extension cap 104 is being attached.

In any embodiment, all of the thicknesses, widths, lengths, and other dimensions described above can be adjusted or varied to fit any size existing wall cap 102, environmental factors, support or strength requirements, or any other factor necessitating a smaller or larger extension cap 104.

As illustrated in FIG. 3C, in some embodiments, the first portion 108, second portion 110, third portion 126, and fourth portion 128 can form an "h" shaped (in cross-section or end view) extension cap 104 to help "raise" or increase the effective height/elevation of the existing retaining wall 101 and wall cap 102.

Each of the embodiments described above can be formed in sections of various lengths to accommodate a number of scenarios, for instance, contractor lifting capacity, curves in the existing retaining walls, tie-back requirements, tie-back locations, etc.

Another aspect of the present disclosure is directed to a method of extending a retaining wall. FIG. 4 illustrates a flow chart of an example method 400 of extending a retaining wall, the retaining wall including an existing wall cap having an upper surface defining an elevation of the retaining wall, the upper surface having a length and a width, according to some embodiments of the present disclosure. In some embodiments, the first step 402 of the method 400 comprises engaging an extension cap with the existing wall cap of the retaining wall, the extension cap comprising a first portion arranged to be received by the upper surface of the existing wall cap and a second portion integrally formed with the first portion and extending vertically upward from the first portion, so as to extend the elevation of the retaining wall. In performing the method herein, any suitable extension cap, including any of the embodiments described herein can be used. Other method aspects associated with extending a retaining wall are readily evident from the disclosure of the retaining wall extension system as otherwise provided herein.

Many modifications and other embodiments of the inventions set forth herein will come to mind to one skilled in the art to which these disclosed embodiments pertain having the benefit of the teachings presented in the foregoing descriptions and the associated drawings. Therefore, it is to be understood that embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

It should be understood that although the terms first, second, etc. may be used herein to describe various steps or calculations, these steps or calculations should not be limited by these terms. These terms are only used to distinguish one operation or calculation from another. For example, a first calculation may be termed a second calculation, and, similarly, a second step may be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

That which is claimed:

1. A retaining wall extension system for extending a retaining wall, the retaining wall including an existing wall cap having an upper surface defining an elevation of the retaining wall, the upper surface having a length and a width, the retaining wall extension system comprising:

an extension cap arranged to be received by the existing wall cap of the retaining wall, the extension cap comprising:

a first portion arranged to be received by the upper surface of the existing wall cap; and a second portion integrally formed with the first portion, the second portion extending vertically upward from the first portion so as to extend the elevation of the retaining wall, wherein the existing wall cap has an inner-facing surface and an outer-facing surface, and wherein the system comprises one or more securing devices each including a tether portion engaged with and extending from the second portion inwardly past the inner-facing surface of the existing wall cap to an anchor portion, wherein the second portion defines one or more drainage holes extending therethrough.

2. The retaining wall extension system of claim 1, comprising an adhesive material disposed at least between the first portion and the upper surface of the existing wall cap to secure the extension cap thereto.

3. The retaining wall extension system of claim 2, comprising a spacer arranged to space the first portion from the upper surface of the existing wall cap so as to define a gap therebetween for receiving the adhesive material therein to secure the first portion to the existing wall cap.

4. The retaining wall extension system of claim 2, wherein the first portion includes an upper surface and a lower surface, and defines a plurality of holes each extending through the first portion, the holes being arranged to receive a reinforcing bar through the lower surface of the first portion, the reinforcing bar being engaged with and extending from the upper surface of the existing wall cap, and to receive the adhesive material through the upper surface of the first portion, the adhesive material being arranged to interact between the first portion and the reinforcing bars within the holes to secure the first portion to the existing wall cap.

5. The retaining wall extension system of claim 2, wherein the adhesive material is a grout material, an ultra-high performance concrete material, or an epoxy material.

6. The retaining wall extension system of claim 1, wherein the extension cap is comprised of a concrete material, one or more composite materials, or recycled plastics material.

7. The retaining wall extension system of claim 1, wherein the extension cap is formed by casting prior to being received by the existing wall cap or formed by casting in place on the existing wall cap.

8. The retaining wall extension system of claim 1, wherein the existing wall cap has an inner-facing surface and an outer-facing surface, and the extension cap comprises a third portion integrally formed with the first portion, the third portion extending downward from the first portion along the outer-facing surface of the existing wall cap.

9. The retaining wall extension system of claim 8, wherein the third portion includes an outer surface and an inner surface, and defines a plurality of holes each extending through the third portion, one or more of the holes being arranged to receive a reinforcing bar engaged with and extending from the outer-facing surface of the existing wall cap, and to receive the adhesive material through the outer surface of the third portion, the adhesive material being arranged to interact between the third portion and the reinforcing bars within the one or more of the holes to secure the third portion to the outer-facing surface of the existing wall cap.

10. The retaining wall extension system of claim 8, wherein the extension cap comprises a fourth portion integrally formed with the first portion, the fourth portion extending downward from the first portion along the inner-facing surface of the existing wall cap, and wherein the fourth portion includes an outer surface and an inner surface, and defines a plurality of holes each extending through the fourth portion, one or more of the holes being arranged to receive a reinforcing bar engaged with and extending from the inner-facing surface of the existing wall cap, and to receive the adhesive material through the outer surface of the fourth portion, the adhesive material being arranged to interact between the fourth portion and the reinforcing bars within the one or more of the holes to secure the fourth portion to the inner-facing surface of the existing wall cap.

11. The retaining wall extension system of claim 1, wherein the retaining wall is a seawall.

12. A method of extending a retaining wall, the retaining wall including an existing wall cap having an upper surface defining an elevation of the retaining wall, the upper surface having a length and a width, the method comprising:

engaging an extension cap with the existing wall cap of the retaining wall, the extension cap comprising a first portion arranged to be received by the upper surface of the existing wall cap and a second portion integrally formed with the first portion and extending vertically upward from the first portion, so as to extend the elevation of the retaining wall, wherein the existing wall cap has an inner-facing surface and an outer-facing surface, and the method further comprises securing the extension cap with one or more securing devices each including a tether portion engaged with and extending from the second portion inwardly past the inner-facing surface of the existing wall cap to an anchor portion, wherein the second portion defines one or more drainage holes extending therethrough.

13. The method of claim 12, comprising disposing an adhesive material at least between the first portion and the upper surface of the existing wall cap to secure the extension cap thereto.

14. The method of claim 13, comprising arranging a spacer between the first portion and the upper surface of the existing wall cap so as to define a gap therebetween, wherein disposing an adhesive material comprises disposing the adhesive material within the gap to secure the first portion to the existing wall cap.

15. The method of claim 13, wherein the first portion includes an upper surface and a lower surface, and defines a plurality of holes each extending through the first portion, and wherein the method comprises:

receiving a reinforcing bar in one or more of the holes through the lower surface of the first portion, the reinforcing bar being engaged with and extending from the upper surface of the existing wall cap; and receiving the adhesive material through the upper surface of the first portion such that the adhesive material interacts between the first portion and the reinforcing bars within the one or more of the holes to secure the first portion to the existing wall cap.

16. The method of claim 13, wherein disposing the adhesive material comprises disposing a grout material, an ultra-high performance concrete material, or an epoxy material at least between the first portion and the upper surface of the existing wall cap.

17. The method of claim 12, wherein the extension cap is comprised of a concrete material, one or more composite materials, or recycled plastics material, and wherein the method comprises forming the extension cap by casting the concrete material prior to being received by the existing wall cap, or forming the extension cap by casting the concrete material in place on the existing wall cap.

18. The method of claim 12, wherein the existing wall cap has an inner-facing surface and an outer-facing surface, and the extension cap comprises a third portion integrally formed with the first portion and extends downward therefrom, and wherein engaging the extension cap comprises engaging the extension cap with the existing wall cap such that the third portion extends along the outer-facing surface of the existing wall cap.

19. The method of claim 18, wherein the third portion includes an outer surface and an inner surface, and defines a plurality of holes each extending through the third portion, and wherein the method comprises:

receiving a reinforcing bar in one or more of the holes, the reinforcing bar being engaged with and extending from the outer-facing surface of the existing wall cap; and receiving the adhesive material in the one or more of the holes through the outer surface of the third portion, such that the adhesive material interacts between the third portion and the reinforcing bars within the one or more of the holes to secure the third portion to the outer-facing surface of the existing wall cap.

20. The method of claim 18, wherein the extension cap comprises a fourth portion integrally formed with the first portion, and wherein engaging the extension cap comprises engaging the extension cap with the existing wall cap such that the fourth portion extends along the inner-facing surface of the existing wall cap, wherein the fourth portion includes an outer surface and an inner surface, and defines a plurality of holes each extending through the fourth portion, and wherein the method comprises:

receiving a reinforcing bar in one or more of the holes, the reinforcing bar being engaged with and extending from the inner-facing surface of the existing wall cap; and receiving the adhesive material in the one or more of the holes through the outer surface of the fourth portion, such that the adhesive material interacts between the fourth portion and the reinforcing bars within the one or more of the holes to secure the fourth portion to the inner-facing surface of the existing wall cap.

* * * * *